US007913397B2

(12) United States Patent
van Deursen

(10) Patent No.: US 7,913,397 B2
(45) Date of Patent: Mar. 29, 2011

(54) FOLDING POCKET UTILITY KNIFE

(75) Inventor: Gary E. van Deursen, Essex, CT (US)

(73) Assignee: American Safety Razor, Verona, VA (US)

( * ) Notice: Subject to any disclaimer, the term of this patent is extended or adjusted under 35 U.S.C. 154(b) by 251 days.

(21) Appl. No.: 12/363,426

(22) Filed: Jan. 30, 2009

(65) Prior Publication Data

US 2009/0193662 A1 Aug. 6, 2009

Related U.S. Application Data

(60) Provisional application No. 61/006,749, filed on Jan. 30, 2008.

(51) Int. Cl.
*B26B 1/02* (2006.01)
*B26B 5/00* (2006.01)

(52) U.S. Cl. ..... 30/154; 30/161; 30/156; 30/330

(58) Field of Classification Search ..... 30/154, 30/161, 125, 162, 153, 156, 330, 155, 157, 30/329, 331, 339
See application file for complete search history.

(56) References Cited

U.S. PATENT DOCUMENTS

| | | | | |
|---|---|---|---|---|
| D256,427 | S | 8/1980 | Lile | |
| D304,154 | S | 10/1989 | Osterhout | |
| 4,936,014 | A | 6/1990 | Shaanan et al. | |
| 5,769,094 | A * | 6/1998 | Jenkins et al. | 30/161 |
| D408,706 | S | 4/1999 | Elishewitz | |
| D433,914 | S | 11/2000 | Chu | |
| 6,354,007 | B1 | 3/2002 | Scarla | |
| D461,387 | S | 8/2002 | Glesser | |
| 6,688,003 | B2 | 2/2004 | Scarla | |
| D488,697 | S | 4/2004 | Rae | |
| D494,437 | S | 8/2004 | Scarla | |
| D494,440 | S | 8/2004 | Carter, III | |
| D501,782 | S | 2/2005 | Ping | |
| D517,892 | S | 3/2006 | Galyean | |

(Continued)

FOREIGN PATENT DOCUMENTS

| | | |
|---|---|---|
| GB | 2 396 129 | 6/2004 |

OTHER PUBLICATIONS

International Search Report and Written Opinion of the International Searching Authority issued in International Patent Application No. PCT/US2009/032625, mailed Mar. 13, 2009.

(Continued)

*Primary Examiner* — Ghassem Alie
(74) *Attorney, Agent, or Firm* — McDermott Will & Emery LLP

(57) ABSTRACT

A folding pocket utility knife includes a front handle, and a rear handle pivotally mounted to the front handle via a pivot. The rear handle contains a cavity configured to contain at least a portion of the front handle within the cavity. A blade holder is mounted inside the front handle for holding a blade, and a bendable blade strap is attached to the blade holder and to the rear handle. The blade strap extends around an outer circumference of the pivot to move the blade holder from a closed position where the front handle is in the cavity and the blade is completely within the front handle, to an open position where the front handle is not in the cavity and the blade extends from a terminal end of the front handle.

5 Claims, 10 Drawing Sheets

U.S. PATENT DOCUMENTS

| | | | | |
|---|---|---|---|---|
| D519,817 | S | 5/2006 | Wong | |
| 7,040,022 | B2 | 5/2006 | Ping | |
| D522,835 | S | 6/2006 | Ping | |
| D526,877 | S | 8/2006 | Ping | |
| D526,878 | S | 8/2006 | Ping | |
| D530,180 | S | 10/2006 | Klecker et al. | |
| 7,134,207 | B2 | 11/2006 | Ping | |
| D543,822 | S | 6/2007 | Ping | |
| D522,955 | S | 10/2007 | Ping | |
| 7,814,664 | B2 * | 10/2010 | LeBlanc et al. | 30/161 |
| 2004/0103541 | A1 | 6/2004 | Scarla | |
| 2004/0154170 | A1 | 8/2004 | Kain et al. | |
| 2005/0055833 | A1 * | 3/2005 | Scarla | 30/156 |
| 2005/1005583 | | 3/2005 | Scarla | |
| 2005/0204567 | A1 | 9/2005 | Ping | |
| 2007/0130777 | A1 | 6/2007 | Ping | |
| 2007/0214652 | A1 | 9/2007 | Ping | |
| 2007/0294895 | A1 | 12/2007 | Ping | |

OTHER PUBLICATIONS

Locarno Registration No. 448287, Leatherman Tool Group, Knife Blades, dated Dec. 13, 2005, retrieved from http://oami.europa.eu/RCDOnline/RequestManager.

* cited by examiner

FOLDING POCKET UTILITY KNIFE

CROSS REFERENCE TO PROVISIONAL APPLICATION

This application is based upon and claims the benefit of priority from Provisional U.S. Patent Application No. 61/006,749 filed on Jan. 30, 2008, the entire contents of which are incorporated by reference herein.

TECHNICAL FIELD

The present disclosure relates to a folding pocket utility knife. The present disclosure has particular applicability to folding utility knives with replaceable blades.

BACKGROUND

Utility knives having replaceable blades are used in a variety of applications, such as in carpentry, floor covering installations, hobby work, mechanical work, electrical work, etc.

Typical utility knives comprise a blade carrier slidably received in a handle or housing for carrying and moving knife blade into and out of the handle or housing and for selectively conducting the cutting operation. However, these knives require two hands to properly close the blade. In addition, upon opening and closing the knife, the blade is exposed in a collapsible position which results in a safety hazard before and after use. One such knife, covered by U.S. Pat. No. 7,134,207 B2, has a rear handle attached to a front blade holder. When the knife is closed, the blade holder and blade pivot into the handle. The blade remains exposed during this movement. When opening the knife the blade holder pivots out with the blade fully exposed.

SUMMARY

To overcome the above mentioned problems, the present disclosure is directed toward a foldable utility knife capable of slidably extending and retracting a blade upon opening and closing, and additionally being opened with one hand.

One embodiment of the present disclosure is directed toward a folding pocket utility knife comprising a front handle, a rear handle pivotally mounted to the front handle via a pivot, wherein the rear handle contains a cavity configured to contain at least a portion of the front handle within the cavity, a blade holder mounted inside the front handle for holding a blade, and a bendable blade strap attached to the blade holder and to the rear handle. The blade strap extends around an outer circumference of the pivot to move the blade holder from a closed position where the front handle is in the cavity and the blade is completely within the front handle, to an open position where the front handle is not in the cavity and the blade extends from a terminal end of the front handle.

In another embodiment, the blade holder is slidably extendible along the lengthwise direction of the front handle such that the blade extends from the terminal end of the front handle at an opposite side from the rear handle when the knife is in the open position, and the blade retracts inside the front portion of the front handle when the knife is in the closed position.

In yet another embodiment, the blade is mounted to the blade holder by a retaining member. Additionally, the blade is removable from the blade holder. In another embodiment, the blade is removed by a blade releasing mechanism by pushing a release button on a side face of the front handle section of the knife, thereby pushing a retaining member out from a groove in the blade and allowing the blade to be removed from the front handle section.

In another embodiment, the utility knife further comprises a finger rest and a thumb stud configured such that a user may open the utility knife with one hand. In this embodiment, the finger rest is located on a portion of the front handle opposite the blade. Additionally, the thumb stud is located on a side face of the front handle of the knife.

Additional advantages and other features of the present disclosure will be set forth in part in the description which follows and in part will become apparent to those having ordinary skill in the art upon examination of the following or may be learned from the practice of the disclosure. The advantages of the disclosure may be realized and obtained as particularly pointed out in the appended claims.

As will be realized, the present disclosure is capable of other and different embodiments, and its several details are capable of modifications in various obvious respects, all without departing from the disclosure. Accordingly, the drawings and description are to be regarded as illustrative in nature, and not as restrictive.

BRIEF DESCRIPTION OF THE DRAWINGS

Reference is made to the attached drawings, wherein elements having the same reference numeral designations represent like elements throughout, and wherein.

DETAILED DESCRIPTION

Figure 1:
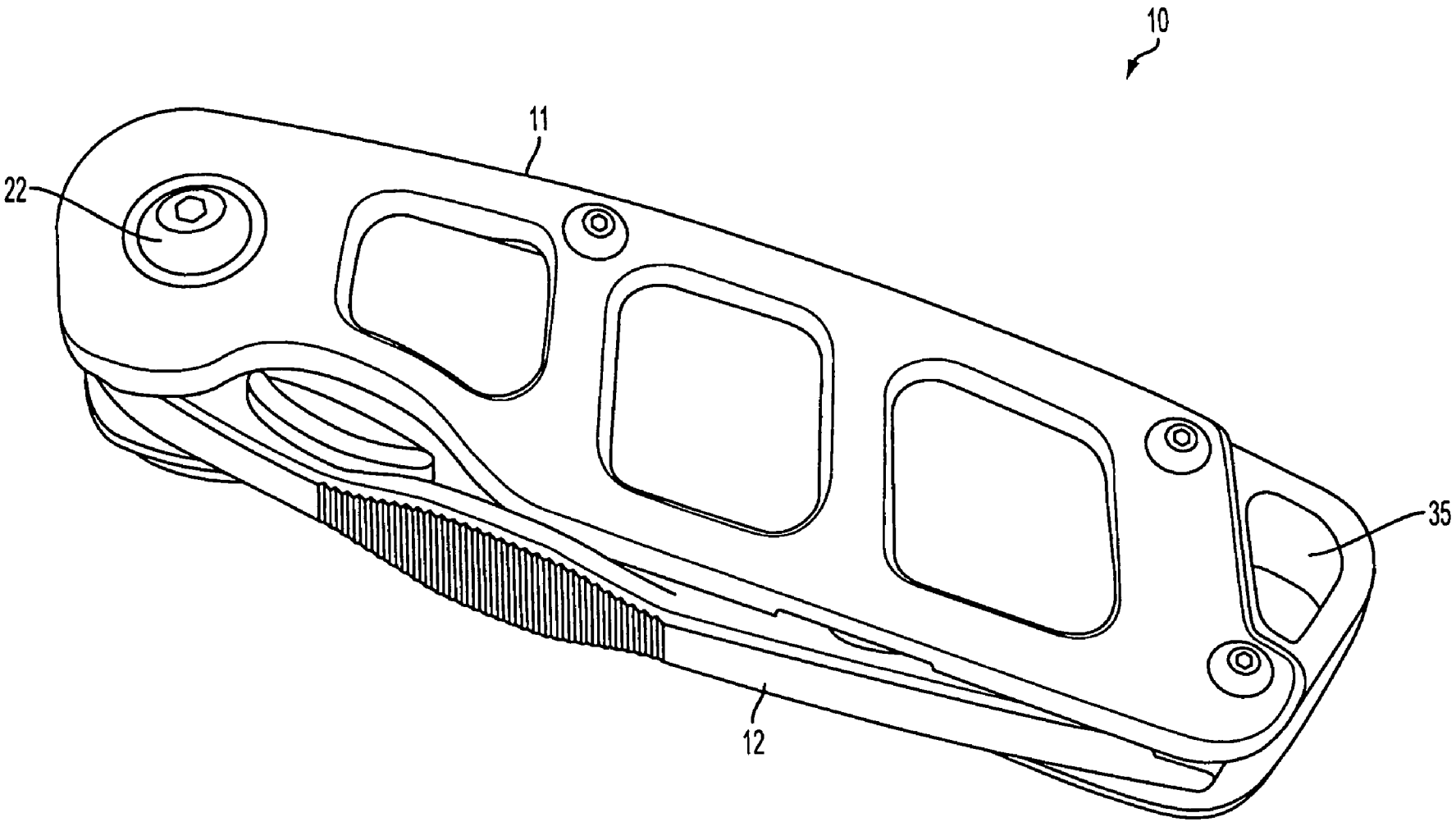
FIG. 1 is a perspective view of a folding pocket utility knife in the closed position according to an embodiment of the present disclosure.

Referring now to the figures, wherein like reference characters represent like elements or features throughout the various drawings, the folding utility knife of the present disclosure is indicated generally in the figures by reference character 10.

Figure 2:
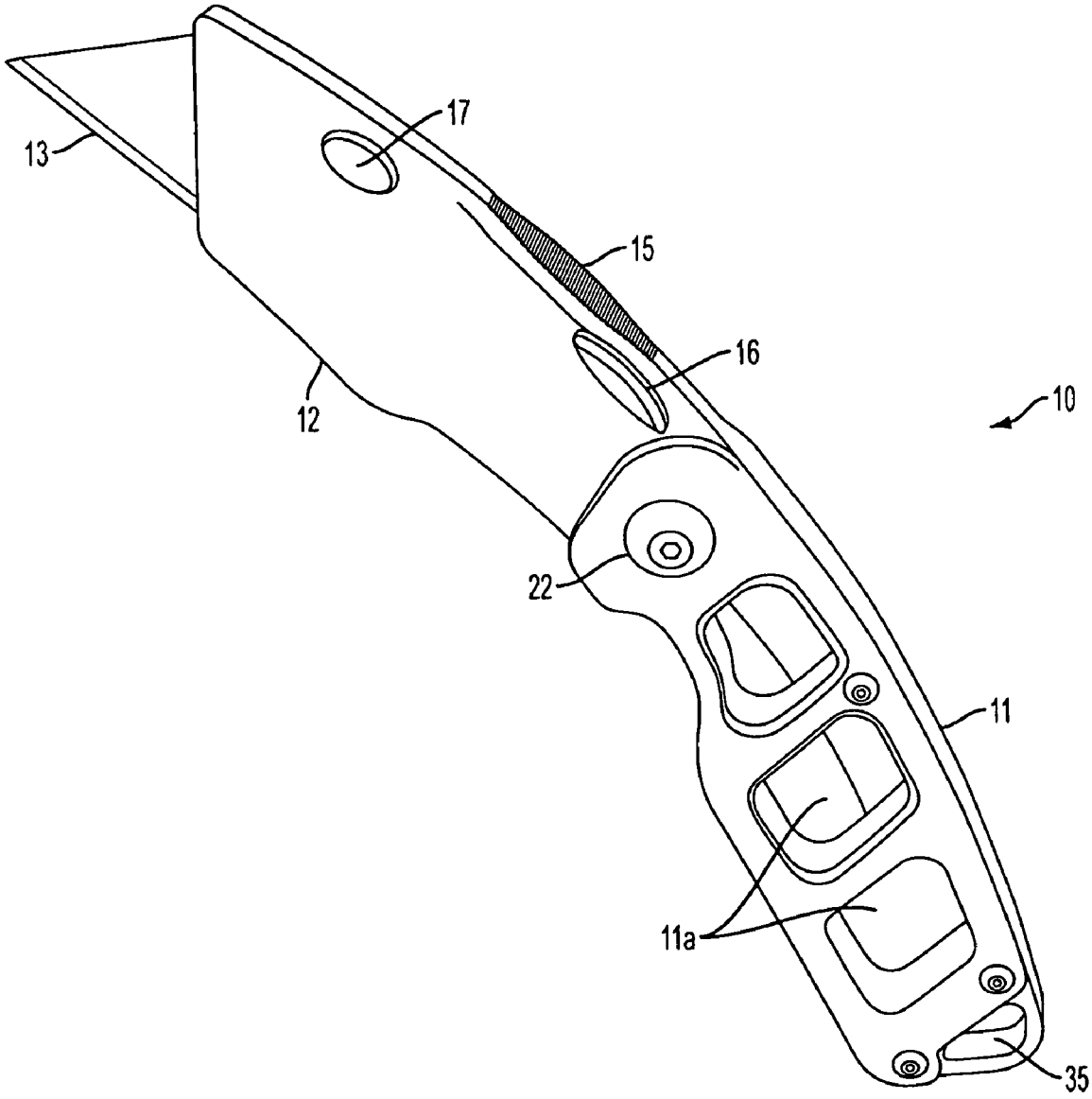
FIG. 2 is a perspective view of the knife of FIG. 1 in the open position.
Figure 4:
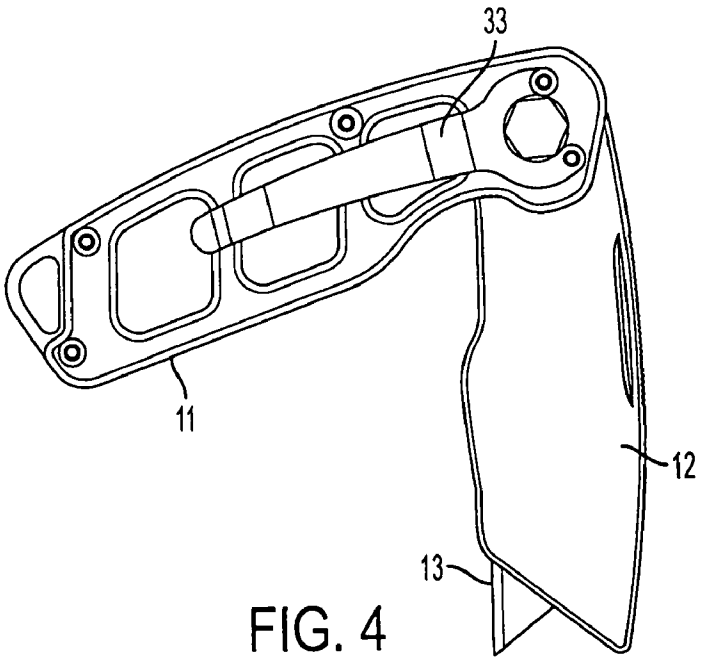
FIG. 4 is a perspective view of the knife of FIG. 1 in the partially open position
Figure 3:
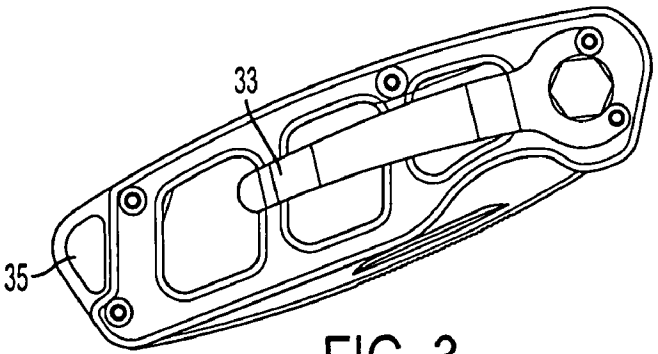
FIG. 3 is a perspective view of the knife of FIG. 1 in the closed position.
Figure 5:
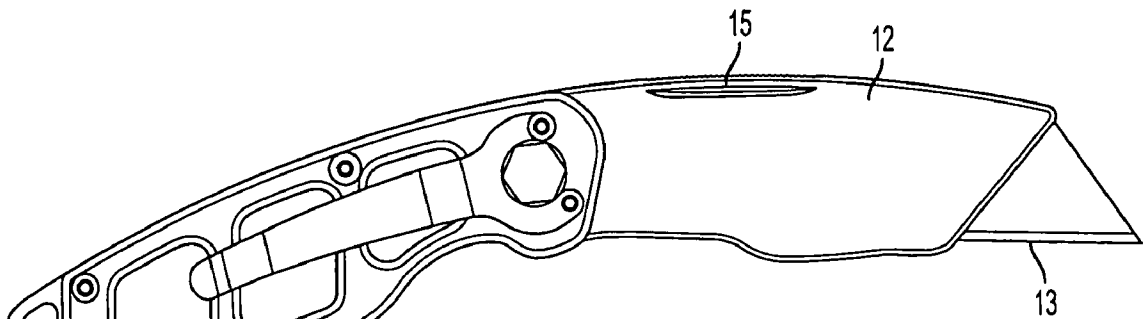
FIG. 5 is a perspective view of the knife of FIG. 1 in the open position.
Figure 7:
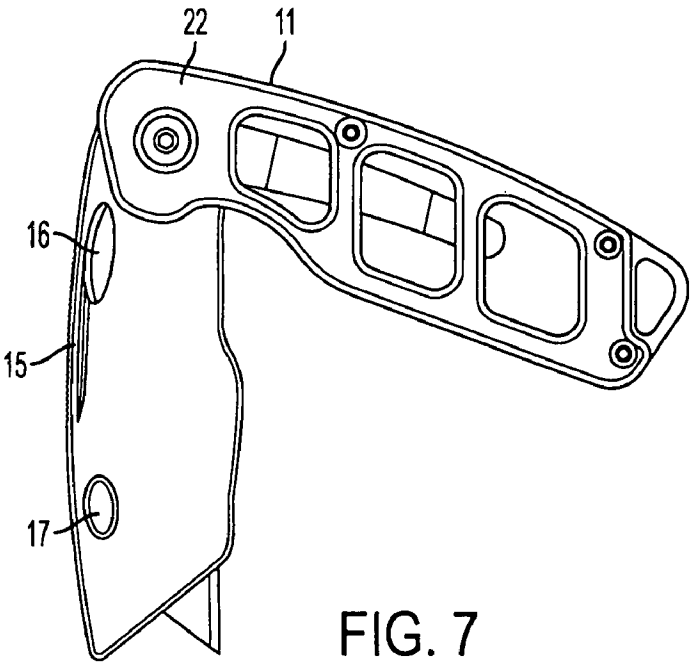
FIG. 7 is a perspective view of the knife of FIG. 1 in the partially open position
Figure 8:
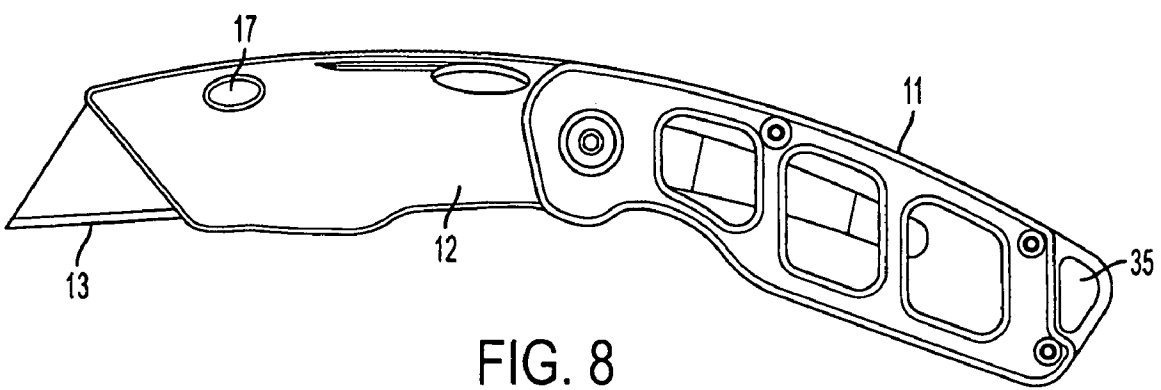
FIG. 8 is a perspective view of the knife of FIG. 1 in the open position.
Figure 6:
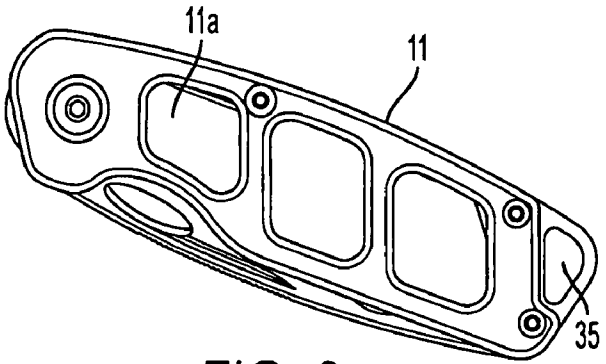
FIG. 6 is a perspective view of the knife of FIG. 1 in the closed position.

FIGS. 1 and 2 show a utility knife 10 having a rear handle 11, which may include cut-outs 11*a*, pivotally mounted to a front handle 12. The rear handle 11 has a cavity for holding at least a portion of the front handle 12 when the knife 10 is in the closed position. As shown in FIGS. 13*a-j*, inside the front handle section 12 is a sliding blade holder 14, with a utility blade 13 attached to the sliding blade holder 14. The utility blade 13 is a standard utility blade known to those skilled in the art. The sliding blade holder 14 is connected to the rear handle 11 by a thin stainless metal or other bendable but rigid blade strap 50. The blade strap 50 wraps around the connecting pivot point 22.

Figure 9:
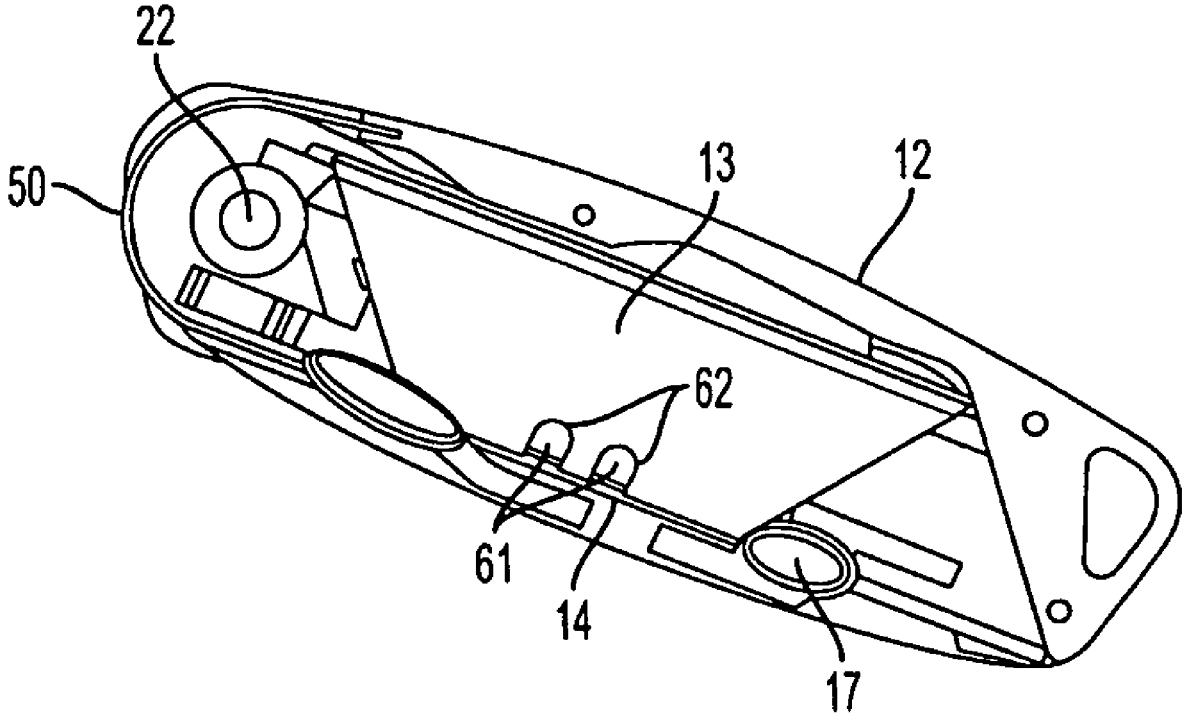
FIG. 9 is a perspective view of the knife of FIG. 1 in the closed position.

FIG. 9 shows the blade 13 held into the formed blade holder 14 with bent metal (or other material) fingers 61. To change the blade 13, a button 17 is pushed on a side face of the front handle section 12 of the knife 10 which pushes one of the retainer fingers 61 out from a groove 62 in the blade. Once the finger is clear from the groove 62, the blade 13 can be slid forward and out to be changed.

Figure 10:
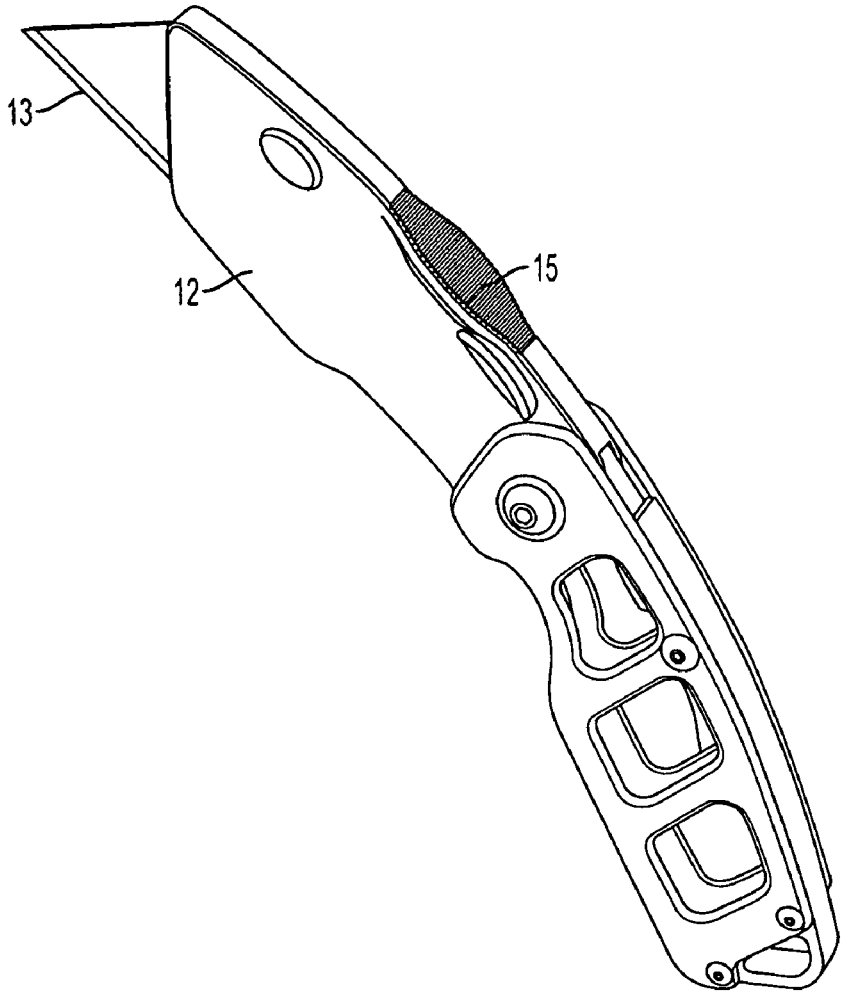
FIG. 10 is a perspective view of the knife of FIG. 1 in the open position.
Figure 11:
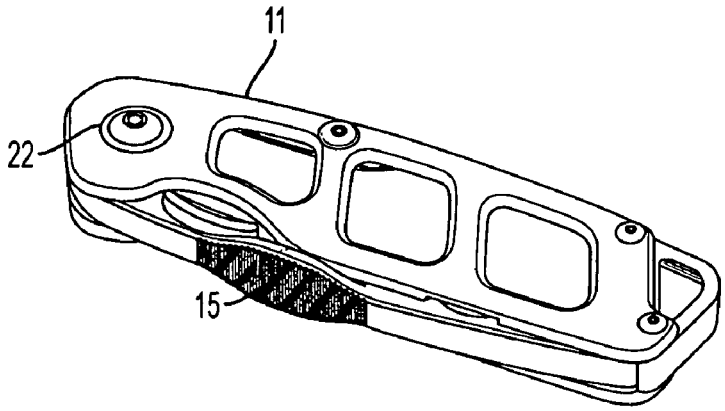
FIG. 11 is a perspective view of the knife of FIG. 1 in the closed position.
Figure 12:
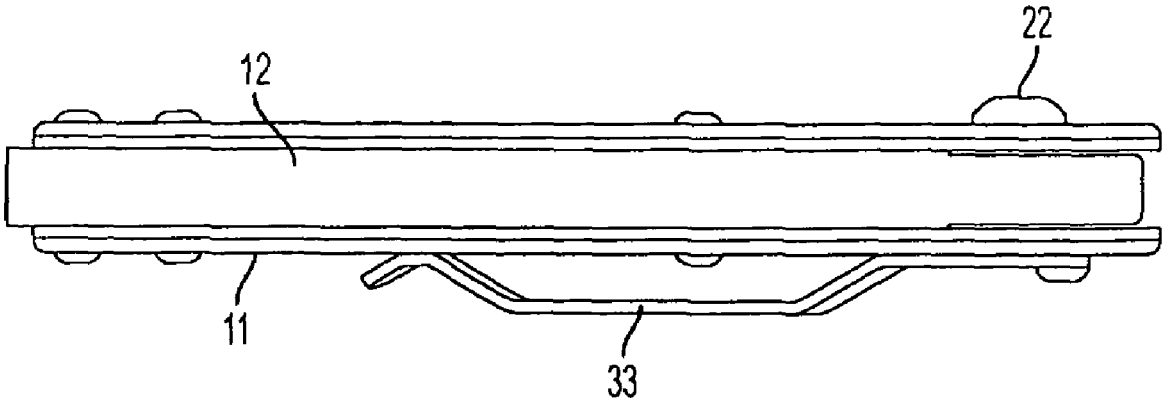
FIG. 12 is a perspective view of the knife of FIG. 1 in the closed position; and, FIGS. 13*a-j* are a collection of drawings of the knife of FIG. 1 and its use

One embodiment, shown in FIG. 2, has a finger rest 15 used for one-handed opening of the knife 10. The finger rest 15 is on the top of the front handle 12. A view from other angles is shown in FIGS. 10 and 11.

FIGS. 3-8 show opposing side views of the knife 10 during opening and closing. Upon following either the sequence of FIGS. 3-5 or FIGS. 6-8, when the knife 10 is opened, the blade 13 is seen progressively extending out from the front handle 12. This is accomplished by the blade strap 50 forcing the blade holder 14 forward, exposing the blade 13 in the front of the knife 10. When the knife 10 is closing, the curving of the strap around the pivot 22 pulls the blade holder 14 back into the front handle 12, thereby retracting the blade 13 into the blade holder.

Figure 13A:
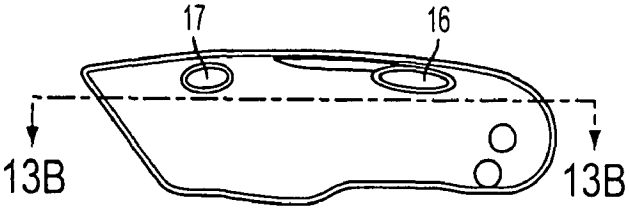
Figure 13B:
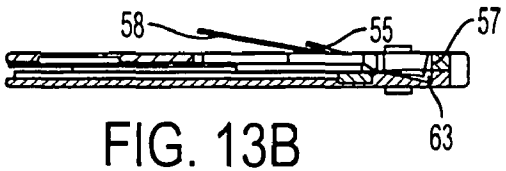
Figure 13D:
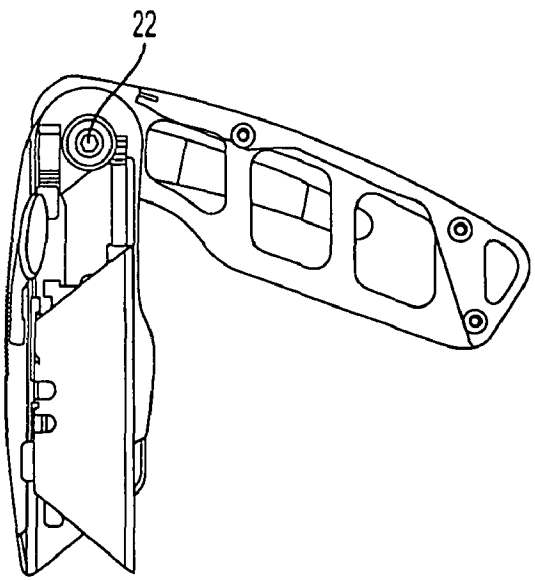
Figure 13C:
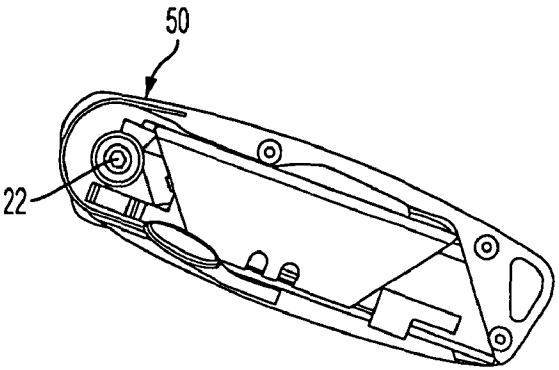
Figure 13E:
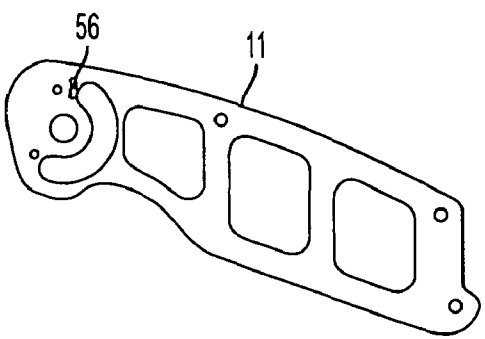
Figure 13I:
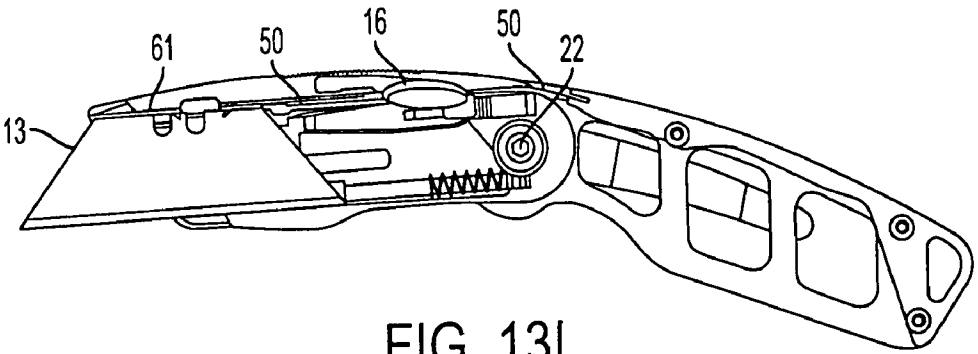
Figure 13J:
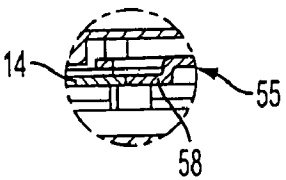
Figure 13F:
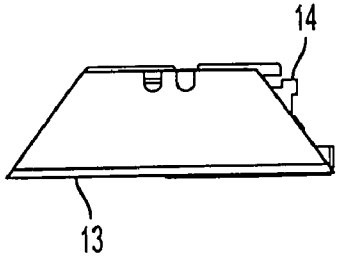

Operation of the knife 10 is shown in greater detail in FIGS. 13*a-j*. As the knife 10 is opened, blade strap 50, such as a flexible plastic strap, unfolds around the pivot 22 and forces the blade carrier 14 out of the handle. When fully open, the locking tab 55 pivots like a seesaw, a rear end 57 snaps down into a slot 56 on the rear handle 11, and a front end 58 pivots up to lock the blade carrier 14 in the forward open position. A close up top view of the front end 58 locking the blade carrier in the forward position is shown in FIG. 13*j*. In addition, a top view of the rear end 57 in the locking tab slot 56 is shown in FIG. 13*b* as well. A button 16 on the front handle, side area detents into a lock position.

Figure 13G:
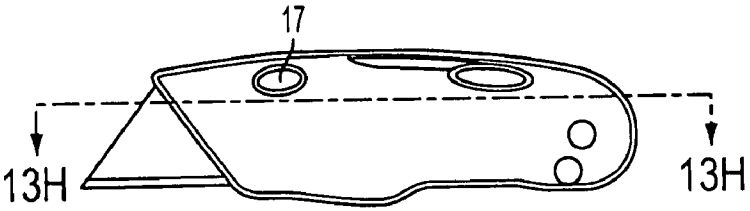
Figure 13H:
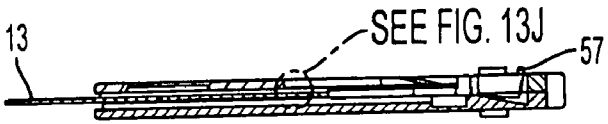

To close the knife 10, as shown in FIG. 13*i* the lock release button 16 is pressed, forcing the blade lock 58 (FIG. 13*j*) to pivot in the opposite direction, and forcing the rear end of the locking tab 57 (FIG. 13*h*) out of the locking tab slot 56 (FIG. 13*e*), and at the same time moving the front end of the locking tab 58 away from the rear end of the blade carrier 14 (FIGS. 13*b* and 13*g*). This allows the blade carrier 14 to slide back into the front handle 12 and the blade 13 to retract. The blade 13 is completely retracted into the front handle when the knife 10 is folded closed, as shown in FIG. 13*c*. As can be seen in FIG. 13*b*, the top view of the closed knife shows the inside portion of the front handle has a gap 63 which can accommodate the pivoted rear end 57 of the locking tab 55 when the lock release button 16 is engaged.

In another embodiment of the knife 10, a keychain holder 35 is included at the end of the knife 10 opposite the pivot 22 as shown in FIG. 1. Another feature of the knife 10 is a pocket clip 33, shown in FIGS. 3-5 and 12. The pocket clip 33 is comprised of a rigid arm attached to the rear handle and extending along the side of the rear handle 11 with sufficient space between the handle in order to be hooked onto an object such as a belt, a pocket or other similar object.

Figure 14:
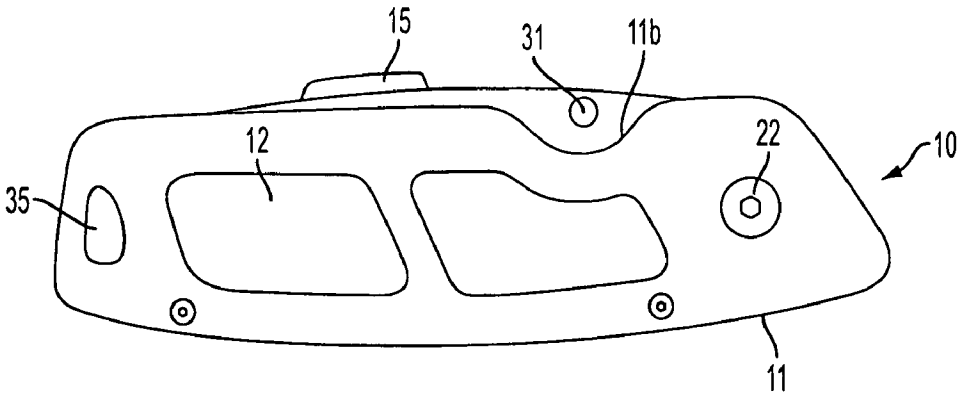
FIG. 14 is a side elevational view of a folding pocket utility knife in the closed position according to another embodiment of the present disclosure.
Figure 15:
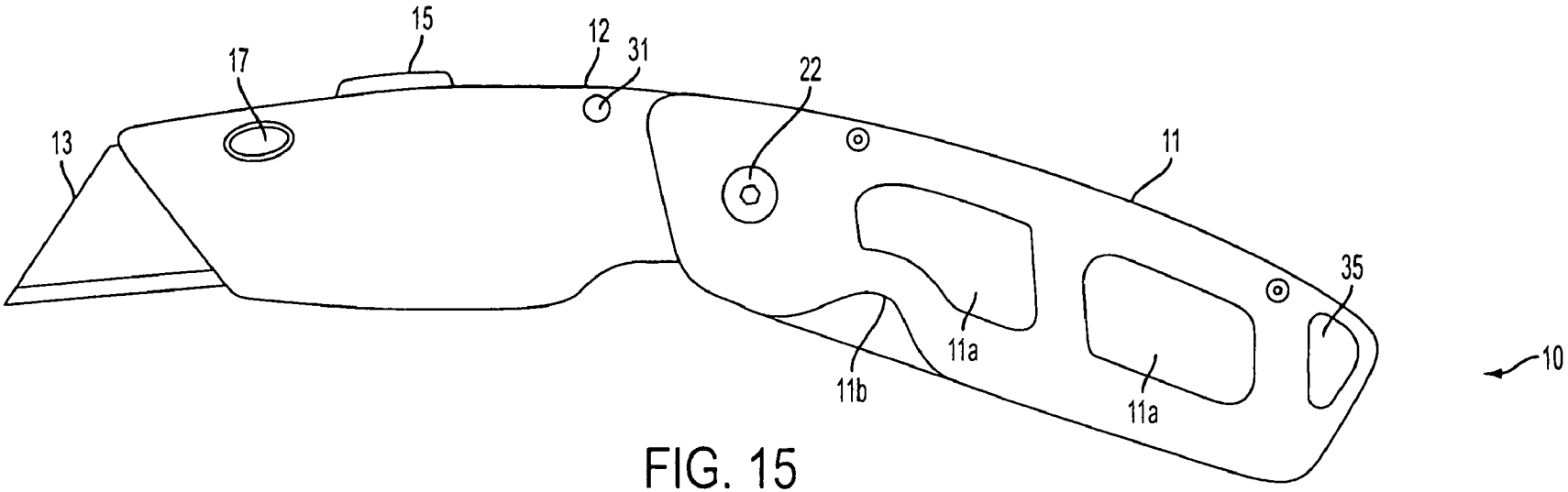
FIG. 15 is a side elevational view of the knife of FIG. 14 in the open position.

In another embodiment, a thumb stud 31 is used for one-handed opening of the knife 10. As shown in FIG. 14, the thumb stud 31 is set on the side face of the front handle 12 in an area accessible via a curved portion 11*b* of the rear handle 11. The curved portion 11*b* provides the user access to the thumb stud 31 while the knife 10 is in a closed position. FIG. 15 shows the knife 10 in an open position.

The present disclosure can be practiced by employing conventional materials, methodology and equipment. Accordingly, the details of such materials, equipment and methodology are not set forth herein in detail. In the previous descriptions, numerous specific details are set forth, such as specific materials, structures, chemicals, processes, etc., in order to provide a thorough understanding of the disclosure. However, it should be recognized that the present disclosure can be practiced without resorting to the details specifically set forth. In other instances, well known processing structures have not been described in detail, in order not to unnecessarily obscure the present disclosure.

Only a few examples of the present disclosure are shown and described herein. It is to be understood that the disclosure is capable of use in various other combinations and environments and is capable of changes or modifications within the scope of the inventive concepts as expressed herein.

What is claimed is:

1. A folding pocket utility knife comprising:

a front handle;

a rear handle pivotally mounted to the front handle via a pivot, wherein the rear handle contains a cavity configured to receive at least a portion of the front handle; and a blade holder mounted inside the front handle for holding a blade;

a bendable blade strap attached to the blade holder and to the rear handle;

wherein the blade strap extends around an outer circumference of the pivot to move the blade holder from a closed position where the front handle is in the cavity and the blade is completely within the front handle, to an open position where the front handle is not in the cavity and the blade extends from a terminal end of the front handle; wherein the blade holder is slidably extendible along the lengthwise direction of the front handle such that the blade extends from the terminal end of the front handle at an opposite side from the rear handle when the blade holder is in an open position, and the blade retracts inside the front portion of the front handle when the blade holder is in the closed position.

2. The folding pocket utility knife according to claim 1, further comprising a blade releasing mechanism including a release button on a side face of the front handle section of the knife, and a retaining member engageable with a groove in the blade, for removing the blade from the blade holder by pushing the release button to disengage the retaining member from the groove in the blade, allowing the blade to be removed from the front handle section.

3. The folding pocket utility knife according to claim 1, further comprising a finger rest and a thumb stud configured such that a user may open the utility knife with one hand.

4. The folding pocket utility knife according to claim 3, wherein the finger rest is located on a portion of the front handle opposite the blade.

5. The folding pocket utility knife according to claim 3, wherein the thumb stud is located a side face of the front handle.

* * * * *